US011879207B2

(12) United States Patent
Halley

(10) Patent No.: US 11,879,207 B2
(45) Date of Patent: Jan. 23, 2024

(54) DYEING PROCESS TO MINIMIZE WASTE WATER PRODUCTION

(71) Applicant: adidas AG, Herzogenaurach (DE)

(72) Inventor: George David Halley, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 3 days.

(21) Appl. No.: 17/363,723

(22) Filed: Jun. 30, 2021

(65) Prior Publication Data

US 2022/0018063 A1 Jan. 20, 2022

(30) Foreign Application Priority Data

Jul. 17, 2020 (EP) ..... 20186508

(51) Int. Cl.
*D06P 5/20* (2006.01)
*D06P 1/00* (2006.01)

(52) U.S. Cl.
CPC ..... *D06P 5/2011* (2013.01); *D06P 1/0016* (2013.01)

(58) Field of Classification Search
CPC ..... D06P 5/2011; D06P 1/0016
See application file for complete search history.

(56) References Cited

U.S. PATENT DOCUMENTS

2014/0212618 A1 7/2014 Mcbride et al.
2014/0377476 A1 12/2014 Mistry
2018/0354275 A1 12/2018 Milini
2018/0361759 A1 12/2018 Milini
2020/0160424 A1* 5/2020 Page ..... B23K 26/402

FOREIGN PATENT DOCUMENTS

| | | | |
|---|---|---|---|
| CN | 101100808 | 1/2008 | |
| CN | 107284020 | * 10/2017 | ..... B41F 31/08 |
| GB | 1430629 | 3/1976 | |
| GB | 2051899 | 1/1981 | |
| WO | 02063094 | 8/2002 | |
| WO | WO 2013/001306 | * 1/2013 | |

OTHER PUBLICATIONS

Zhang et al. Effect of atmospheric-pressure air/He plasma on the surface properties related to ink-jet printing polyester fabric Vacuum 137 (2017) p. 42-48.*
European Patent Application No. 20186508.6, European Search Report dated Dec. 18, 2020, 8 pages.
Office Action, Chinese Patent Application No. 202110771526.X, dated Aug. 30, 2023, 12 pages.

* cited by examiner

*Primary Examiner* — Amina S Khan
(74) *Attorney, Agent, or Firm* — Kilpatrick Townsend & Stockton LLP

(57) ABSTRACT

The present invention relates to a method of dyeing a textile, yarn or strand, in particular for use in footwear or apparel. The method may comprise the steps of: a) exposing at least a part of the textile, yarn or strand to a plasma field and a laser beam; and b) dyeing the textile, yarn or strand by digital dyeing, c) wherein the plasma field and the laser beam are at least partly overlapping to pre-treat the textile, yarn or strand prior to dyeing, and d) wherein the method is performed inside at least one of chamber(s). The present invention also relates to a textile, yarn or strand dyed according to the method of dyeing as well as to a system adapted for dyeing a textile, yarn or strand.

11 Claims, 4 Drawing Sheets

DYEING PROCESS TO MINIMIZE WASTE WATER PRODUCTION

CROSS REFERENCE TO RELATED APPLICATION

This application is related to and claims priority benefits from European Patent Application No. 20186508.6, filed on Jul. 17, 2020, entitled DYEING PROCESS TO MINIMISE WASTE WATER PRODUCTION ("the '508 application"). The '508 application is hereby incorporated herein in its entirety by this reference.

FIELD OF THE INVENTION

The present invention relates to a method of dyeing textiles, in particular to a method of dyeing textiles with minimised waste water production.

BACKGROUND

Conventional Dyeing

Dyeing of textiles, yarns or strands is a huge industry that creates an enormous amount of product every year. In the dyeing industry, dyestuff is used to colour a wide range of textile fibres such as polyester fibres, nylon fibres, acrylic fibres, and others. The textiles produced from these coloured textile fibres is utilized in end-user industries such as sportswear, home textiles, apparel, automotive textiles, and others.

Colour is one of the most important influences on consumers when they are considering the purchase of clothes in particular. In order to achieve different colours, manufacturers must consider a wide range of possible dyestuffs, but with this selection comes different effects including colour fastness, recommended application method, processing conditions (such as pH, temperature, levelling agents) and ultimately the cost. It is clearly desirable to create fabrics with strong colour fastness that can be produced at minimal cost and with relatively consistent processing conditions when moving between different colours in order to give the factory maximum flexibility in what it produces.

Different dyeing processes are required when colouring different materials. This is largely a result of the affinity each material has to different dye chemistries. One example of a widely used industrial dyeing method is disperse dyeing, which is particularly appropriate when dyeing polyester.

Disperse dyes are almost totally insoluble in water. When in a dye bath, disperse dyes exist as a suspension or dispersion of particles of insoluble pigments. Only a tiny amount of a disperse dye is in true solution at any time. Irregularly dispersed, large particles of dye would result in uneven coverage of the dyed textile, yarn or strand. Dispersing agents are required to disperse the dye in a fine, uniform form suitable for creating uniform dyeing effects.

For disperse dyeing the dye bath may be acidic. For maintaining this pH, generally acetic acid is used. Other suitable acids may also be used. During colour development, correct pH should be maintained otherwise fastness will be inferior and colour will be unstable.

Through the details above, it can be seen that in a conventional dyeing process a large amount of water is necessary as a carrier and this water will be contaminated with many elements such as the dispersing agent and acetic acid.

Aside from the dye itself, there are many stages necessary to create a dyed textile, yarn or strand. Firstly, a textile, yarn or strand must be prepared to receive a dyestuff. The pre-treatment of the textile, yarn or strand may include a series of different cleaning steps to remove dirt and impurities that could have a negative effect on the final dyeing. Pre-treatment may include washing, scouring, bleaching, steaming and many other steps. The pre-treatment steps also require a large amount of water in order to be effective.

Finally, after the dyeing process, the colour may need to be fixed in a fixation process. Additionally, excess dye may need to be removed from the textile, yarn or strand in a washing step. An approximate split of water usage between traditional pre-treatment and traditional dyeing methods is: 40% in pre-treatment, 20% in the actual coloration step and 40% washing off excess dye or in fixation processes. This will vary significantly from plant to plant and will also vary with the type of fibre being processed and the final end use. However, it can be seen that the overall water consumption is very high. Even with good modern processes the amount of water used to colour material by conventional methods is in the order of 35-70 litres per kg of material processed. Most of this water goes to waste carrying various levels of additional substances dissolved within. Many of these substances are hard pollutants. Additionally, much of this water ends up in rivers. Plants to address this sort of effluent from dye houses are very expensive to install and also to run, so in many places these plants are simply not installed. It is a clear goal to minimize this liquid waste in the material colouration process.

Alternatives—Plasma

The industry is beginning to experiment with new processes for each stage of dyeing a textile, yarn or strand that use less water. For the pre-treatment and fixation processes, plasma methods are being developed. Plasma is matter that exists in the form of ions and electrons, resulting from a gas that has been partially ionised. Plasmas carry a large amount of energy. The specifics of the resulting reaction can be finely tuned by selecting an appropriate gas mixture, pressure, power, treatment time, etc.

On an industrial level, plasma treatments are used across a wide range of industries for treating surfaces of various materials prior to any coating, printing or adhesion. The high energy of a plasma can selectively break open the structures of chemical or organic substances on the surface of a textile, yarn or strand. In this way, plasma pre-treatments can remove foreign contaminants present on the surface of a textile, yarn or strand. This is particularly necessary in the dyeing industry where yarns and fabrics can have lubricants or protection layers on the surface that need to be removed before dyeing.

Many plasma treatments give equivalent or improved cleaning results to conventional methods described above. It has been found that dyeing uptake of the material during the dyeing process is also improved. Crucially, the consumption of water and substances dissolved in water is effectively zero. This reduction in water waste is the largest improvement over traditional methods.

Alternatives—Dyeing

Digital dyeing is also a process being trialed in the search for low water usage dyeing methods. Digital dyeing is somewhat similar to the digital printing known well in the fields of paper and textile printing. Ink jet printing is an example of digital printing, where a digital image is recreated on a sheet of paper by propelling droplets of ink onto the paper. The ink or dye does not need to be suspended in water. Thus, digital dyeing is a method of applying colour to a substrate by means of a digitally controlled dispense mechanism. Therefore, this method alone requires lower water consumption than conventional dyeing methods.

Additionally, the amount of dye applied to the textile, yarn or strand is much more closely controlled than in conventional dyeing methods like e.g. dip-dying. Therefore, a washing step may not be required to remove excess dye.

The downside of digital dyeing, similar to digital printing, is that dense coverage is difficult to achieve. Textile colouring is most commonly creating large areas of uniform colour. Therefore, digital dyeing has been developed to be more efficient at producing full width solid colours on textiles, but this is often expensive to achieve and involves very slow production times. There are a number of different textile digital dyeing technologies available on the market, but these are often very expensive, slow to operate and have a low throughput of the material.

Goal and Problems

The goal of the present invention is to utilize higher standards of material pre-treatment using plasmas to prepare for more efficient digital dyeing. In combination, these two technologies require very low quantities of water. Together they create a dyeing process that is far more sustainable and less harmful to the planet than conventional methods.

The general combination of the two methods is known. For example, published Chinese utility model CN101100808 discloses the use of a plasma to modify the surface of a fabric to prepare the fabric for digital inkjet printing. For this method, and other similar methods, the energy consumption by the plasma in order to achieve the necessary change to the fabric surface is high. The energy from the ionized gas particle alone may need to be very high to achieve a noticeable change in the fabric. Additional factors such as high temperature, or elevated pressure, or a vacuum may be necessary to enhance the effects of the plasma. These additional factors not only increase the cost of building the required set-up. These factors also make the machines more complicated, so require more highly trained staff to run. Additionally, these additional steps in preparing the plasma field may significantly slow down the throughput of the pre-treatment machine.

Furthermore, once the fabric exits the plasma field and emerges into the regular atmosphere of the factory, the beneficial effects of the pre-treatment gradually start to degrade. New dust particles start to get deposited again on the surface etc. The longer time between the fabric exiting the plasma and entering the dyeing stage, the less effective the pre-treatment will be. Therefore, the more complicated the plasma set-up, the more likely it is that the dyeing machine will have to be placed at a large distance away and the status of the fabric will degrade when being transported between the two.

Furthermore, in plasma fields it can often be difficult to tune properties across the whole area of the field. A single homogeneous field is achievable, but specific properties in specific areas becomes very complicated.

Solution

The present invention provides a solution to the problems set out above to create a commercially viable way to combine plasma pre-treatments and digital dyeing to nearly eliminate water usage in fabric colouring.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a method of dyeing a textile, yarn or strand, for use in footwear or apparel, comprises the steps of: exposing at least a part of the textile, yarn or strand to a plasma field and a laser beam; and dyeing the textile, yarn or strand by digital dyeing, wherein the plasma field and the laser beam are at least partly overlapping to pre-treat the textile, yarn or strand prior to dyeing, and wherein the method is performed inside at least one chamber.

In some embodiments, the method is performed at atmospheric pressure, room temperature, or a combination thereof.

In certain embodiments, the method further comprises applying a magnetic field, microwave radiation, ultrasound, or a combination thereof to the plasma field.

The plasma field, in some embodiments, is arranged between a first and a second roller electrode.

An overlapping area of the plasma field and the laser beam, in certain embodiments, is arranged between a first and a second roller electrode.

The overlapping area of the plasma field and the laser beam may be adapted to change one of: a morphology of the textile, yarn or strand, a chemical property of the textile, yarn or strand, or a combination thereof.

In some embodiments, dyeing the textile, yarn or strand by digital dyeing comprises dispensing a dye from at least one nozzle or an array of nozzles.

In certain embodiments, the method further comprises at least one of: collecting an excess of the dispensed dye or providing the excess of the dispensed dye back to the at least one nozzle or the array of nozzles.

According to certain embodiments of the present invention, a system adapted for dyeing a textile, yarn or strand, for use in footwear or apparel, comprises: at least one chamber; a mechanism for exposing at least a part of the textile, yarn or strand to a plasma field and a laser beam inside the at least one chamber; a mechanism for dyeing the textile, yarn or strand by digital dyeing inside the at least one chamber; and wherein the plasma field and the laser beam are at least partly overlapping to pre-treat the textile, yarn or strand prior to dyeing.

In some embodiments, the at least one chamber is adapted for use at atmospheric pressure, room temperature, or a combination thereof.

In certain embodiments, the at least one chamber further comprises a mechanism that applies a magnetic field, microwave radiation, ultrasound, or a combination thereof to the plasma field.

The mechanisms for exposing at least a part of the textile, yarn or strand to a plasma field and a laser beam inside the at least one chamber may be adapted to arrange the plasma field between a first and a second roller electrode, to arrange an overlapping area of the plasma field and the laser beam between the first and the second roller electrode, or a combination thereof.

The overlapping area of the plasma field and the laser beam, in some embodiments, is adapted to change one of: a morphology of the textile, yarn or strand, a chemical property of the textile, yarn or strand, or a combination thereof.

In certain embodiments, the mechanism for dyeing the textile, yarn or strand by digital dyeing comprises a mechanism for dispensing a dye from at least one nozzle or an array of nozzles, wherein the system further comprises at least one of: a mechanism for collecting an excess of the dispensed dye, or a mechanism for providing the excess of the dispensed dye back to the at least one nozzle or the array of nozzles.

According to certain embodiments of the present invention, a textile, yarn or strand, for use in footwear or apparel, wherein the textile, yarn or strand is dyed according to the method of claim 1.

BRIEF DESCRIPTION OF THE DRAWINGS

In the following detailed description, embodiments of the invention are described referring to the following figures.

BRIEF DESCRIPTION

Figure 1:
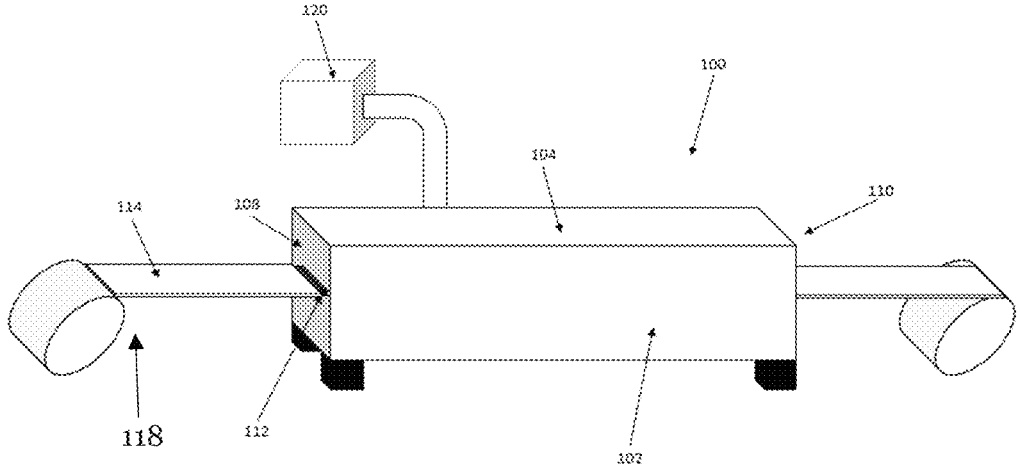
FIG. 1 is a diagram illustrating a chamber according to certain embodiments of the present invention.
Figure 2:
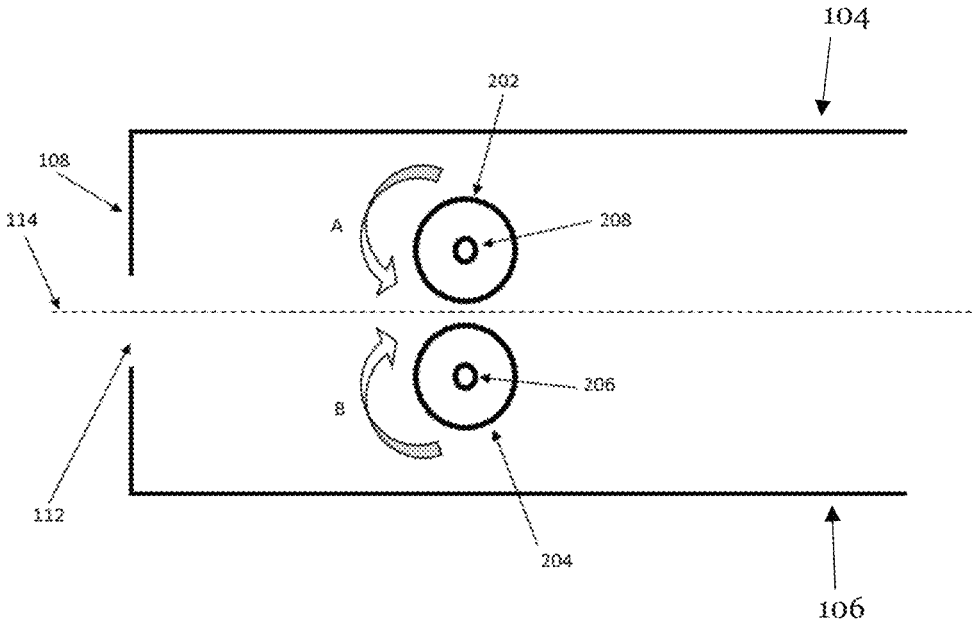
FIG. 2 is a diagram illustrating a side view cut-through of a part of the chamber including pre-treatment mechanisms according to certain embodiments of the present invention.
Figure 3:
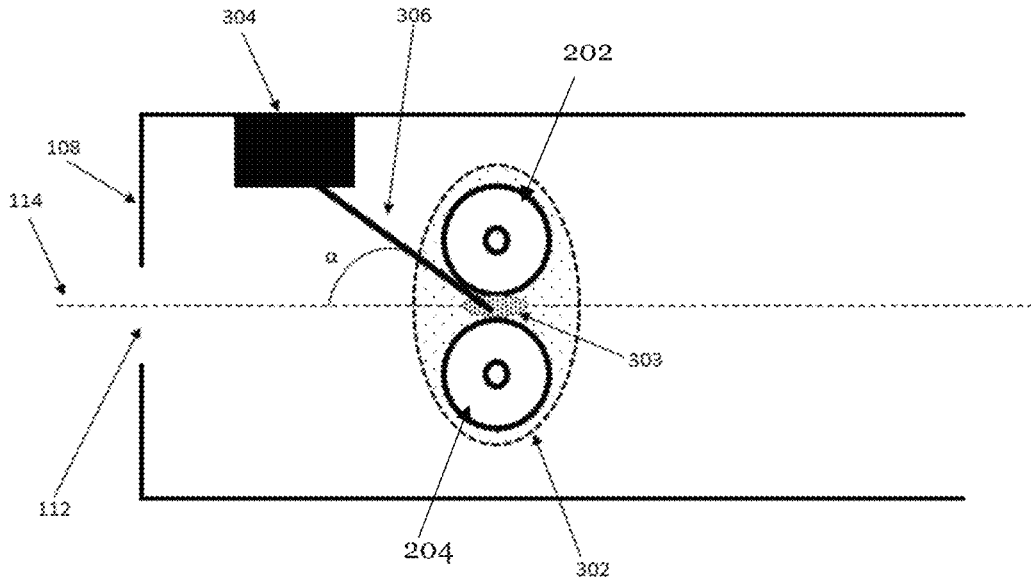
FIG. 3 is a diagram illustrating the energy fields within the chamber according to certain embodiments of the present invention.

The above-mentioned problem is at least partly solved by the subject matter of the independent claims of the present invention. Exemplary embodiments of the invention are defined in the dependent claims.

In some embodiments, the present invention provides a method of dyeing a textile, yarn or strand, in particular for use in footwear or apparel. The method may comprise the steps of: a) exposing at least a part of the textile, yarn or strand to a plasma field and a laser beam; and b) dyeing the textile, yarn or strand by digital dyeing, c) wherein the plasma field and the laser beam are at least partly overlapping to pre-treat the textile, yarn or strand prior to dyeing, and d) wherein the method is performed inside at least one chamber.

In some embodiments, the present invention utilizes a laser in combination with a plasma field to create a high energy and easily tuneable field for more effective pre-treatment of textiles, yarns or strands to be coloured. The use of diverse energy sources creates a large benefit over the other single source plasma technologies currently available. A tuneable field may be modified for use for different textiles, yarns or strands having different pre-treatment needs, and for different dyestuffs that require different features in a textile, yarn or strand to be dyed.

The method according to the invention may be applied to a textile, a single or multiple yarns, or a single or multiple strands, or any combination thereof. A yarn may or may not be arranged in a textile when dyed according to the invention.

In some embodiments of the present invention, both a plasma field and a laser may be tuned. A method of creating a more energetic and effective plasma to clean and activate surfaces may include, for example, ultra-violet laser radiation, either continuous wave or pulsed, combined with electromagnetically generated atmospheric pressure plasma (AP plasma) or any other excitation mechanism to create a more highly ionized and energetic field.

In some embodiments of the present invention, the use of digital dyeing provides another easily tuneable process as part of the overall method of dyeing a textile, yarn or strand. Digital dyeing methods may be controlled electronically to a high degree of accuracy. The density, shade and hue of colour may be changed with relative ease. Changes to the colour may be made quickly and with a high degree of accuracy in comparison to conventional dye baths where the final colour may be unpredictable, and textiles are only dyed in large batches. With current processing, colour forecasts have to be produced a long time in advance of actual production which means they are frequently inaccurate, and this can lead to increased mark downs in retail due to the available stock being the wrong colour.

In some embodiments, the present invention allows for easy and flexible addition of colour to textiles, yarns or strands without huge forward planning, which brings further savings plus further reduction in waste to the textile colouring process. In the context of some embodiments of the present invention, it is understood that the step of dyeing a textile, by digital dyeing may comprise applying dye to individual yarns or strands of the textile.

The ability to quickly and easily modify the pre-treatment parameters, e.g. the working condition of the plasma field, the working condition of the laser beam, the ambient condition inside the chamber, exposure durations of the textile, yarn or strand, etc., and the dyeing parameters, e.g. the used dyestuff, the amount of applied dyestuff, etc., enables high quality processing of a wide range of more challenging materials e.g. recycled polyester and other variable substrates. The same machinery may be used to cover the full range of textiles, yarns or strands being coloured.

In some embodiments of the present invention, both the pre-treatment step and the dyeing step may be performed in a single chamber. Alternatively, both the pre-treatment step and the dyeing step may be performed in adjacent chambers. Alternatively, the pre-treatment step and the dyeing step may be performed in entirely separate chambers in order to suit the layout of any given factory floor. The ability to combine both steps in a single chamber reduces the footprint of the machinery. Therefore, more machinery can fit into a limited factory space. Additionally, combining both steps in a single chamber reduces the risk that the textile, yarn or strand will be contaminated when moving between the pre-treatment step and the dyeing step. The inside of the chamber may be kept relatively clean compared to the outside atmosphere of an operational textile factory.

The method of some embodiments of the present invention may be performed on a continuously moving sheet of textile, a continuously moving yarn, or a continuously moving strand. An untreated sheet of textile, a yarn or a strand can enter the chamber from a roll, as is conventional. The textile, yarn or strand can pass through the AP plasma field and the beam of the laser to be pre-treated. The textile, yarn or strand can then pass directly to the digital dyeing apparatus to be dyed. The textile, yarn or strand can then exit the chamber, fully dyed, ready to be rolled and transported, sold or further processed.

The higher levels of excitation created by the combination of laser and plasma can create a wider window of production for dyeing. The cleaner the textile, yarn or strand is as a result of the pre-treatment cleaning, the longer it may be stored in a production environment, becoming gradually dirtier, before being dyed, while still being clean enough at the dyeing step to effectively receive the dyestuff. This wider production window allows for more flexibility in factory set-up. In factories where a single chamber for both pre-treatment and dyeing is not possible, this wider production window may reduce the risk that a delay in the dyeing step will cause the pre-treated textile, yarn or strand to become too dirty to dye, and the pre-treatment must be repeated.

Digital dyeing does not require long processing times like conventional dyeing methods. The textile, yarn or strand does not have to sit in a dye bath for a long duration. Typical lag times for conventional dyeing steps may be of the order of half an hour. In contrast, digital dyeing processes a continuous sheet of material that is constantly in motion. There is no lag time or soaking time required. A digital dyeing system effectively provides "instant" colouration. Only 1.5 seconds or less is required for the material to be in the processing chamber.

Overall in terms of process speed, some embodiments of the present invention can provide both pre-treatment and dyeing methods that have production speeds of ~50 m/min. There is no time lag in transferring a textile, yarn or strand between the two steps, because they are combined in a single machine. Therefore, assuming a 16-hour working day, 48,000 meters of textile may be processed. In comparison, conventional jet dyeing machines (for dyeing alone, not including the aqueous pre and post treatments plus further additional of functional finishes e.g. wicking or water repellency) can only produce approximately 300 kg each per 4 hours. For textile rolls that are 1.5 m wide, 10 conventional machines would be required to achieve the same amount of processed textile in a single day.

Having a single machine rather than 10 conventional machines reduces the required workforce significantly. This results in lower labour costs.

Combining the digital dyeing and the multiple source plasma pre-treatment can provide a complete dyeing method that requires very little energy compared to conventional processes. Eliminating the need for pressurized vessels, heating, cooling, washing and the many other conventional steps, brings the energy consumption of some embodiments of the present invention down to roughly 5% of conventional dyeing methods. Thus, some embodiments of the present invention can reduce the carbon footprint of textile dyeing as well as the water consumption.

In some embodiments of the present invention, the method may be performed at atmospheric pressure, room temperature or a combination thereof. The use of a secondary energy source, such as the laser in addition to the plasma source, may allow the set-up of the current invention to achieve higher energy plasma fields without the need to elevate temperatures or pressures. Use of atmospheric pressure removes the need for a pressurized vessel to contain the pre-treatment process. An AP plasma may be used. The use of room temperature removes the need for a heated vessel that must be maintained. Removing these requirements simplifies the machinery required. Simplifying the machinery required reduces the cost and reduces the possible risks of running the machinery.

Digital dyeing processes may be performed at room temperature as well. This is in contrast to conventional dyeing processes that must be performed at elevated temperatures, often around 130° C. Combining two processes that can both be performed at room temperature is clearly beneficial. There is no need for heating or cooling steps between the two processes. This reduces energy consumption, speed, and overall cost of production.

The method of some embodiments of the present invention can further comprise applying a magnetic field, microwave radiation, ultrasound or a combination thereof to the plasma field. Adding a magnetic field to the chamber of the claimed method provides an additional energy source. This additional energy source may create a more energetic and therefore effective plasma to clean and activate surfaces of the textile, yarn or strand being treated. Additionally or alternatively, microwaves or ultrasound may be added to the chamber. These can act as further additional energy sources to create a more energetic and therefore effective plasma to clean and activate surfaces of the textile, yarn or strand being treated.

In some embodiments of the present invention, the plasma field may be arranged between a first and a second roller electrode. In other words, an ionized gas that forms the plasma may be created between two electrodes in the form of rollers. Each electrode may have the shape of an elongate cylinder. Each electrode may be configured to rotate about an axis that runs through the centre of each of the bases of the cylinder. The two electrodes may be positioned parallel to each other. The two electrodes may be positioned such that the textile, yarn or strand to be pre-treated runs between the two rollers. The two rollers may be driven to rotate. By driving the rollers, the rollers can transport the textile, yarn or strand through the chamber.

The rollers may be positioned in any orientation within the chamber. The rollers can extend vertically within the chamber. The rollers can extend horizontally in the chamber. When the rollers extend horizontally, one roller may be positioned beneath the textile, yarn or strand when in use and the second roller may be positioned above the textile, yarn or strand when in use.

The roller electrodes may be energized in any suitable way to create an AP plasma. One electrode forms the cathode and the other electrode forms the anode. When energized, the roller electrodes together can form a plasma between the rollers and around the rollers. The plasma field is strongest between the two roller electrodes. This may be known as the 'high energy region'.

The rollers can extend the full width of the chamber. Alternatively, the rollers can extend only a partial width of the chamber.

In some embodiments of the present invention, the laser beam may be incident on a part of the textile, yarn or strand located between the two roller electrodes. Thus, an overlapping area of the plasma field and the laser beam may be arranged between a first and a second roller electrode. The highest energy area of the plasma field is between the two roller electrodes. Adding the laser energy to this high energy region creates the highest energy area of the field achievable. The highest levels of excitation of the surface of the textile, yarn or strand are therefore achievable in this high energy region.

The area covered by the beam of the laser may be a rectangle. The area covered by the beam of the laser may be an elongate, narrow rectangle, configured to match the area of the high energy region between the roller electrodes. In this way uniform excitation by the laser may be provided across the whole textile, yarn or strand being pre-treated.

Alternatively, the area covered by the beam of the laser may be a circular area. The circular area may have a dimeter equal to the separation between the roller electrodes. In this arrangement, the laser is configured to only excite certain portions of the textile, yarn or strand. In this way the excitation of the textile, yarn or strand may be closely controlled, and different dyeing effects may be engineered.

The beam of the laser may be angled perpendicular to the textile, yarn or strand passing through the roller electrodes. Alternatively, the beam of the laser on the textile, yarn or strand may create an angle of $\alpha°$ with the textile, yarn or strand, a being smaller than 90°. For example, the beam of the laser may be incident on the textile, yarn or strand at an angle of 45°. Alternatively, the beam of the laser may be incident on the textile, yarn or strand at an angle of 15° or less. In this instance the beam of the laser may be considered to be close to parallel to the textile, yarn or strand. Different angles of the beam of the laser can produce different excitation levels in the textile, yarn or strand. Additionally, different angles of the beam can achieve different levels of penetration into the textile, yarn or strand. This is particularly useful for knitted or woven materials that are formed of connected layers.

In some embodiments of the present invention, the overlapping of the plasma field and the laser beam may be adapted to change a morphology of the textile, yarn or strand. The use of a multiple energy source AP plasma may cause the substrate to be physically changed. Changes to morphology require high energy levels that are not easily achievable using AP plasmas alone. Only with the addition of a secondary laser source is this possible.

Furthermore, a laser may be so finely tuned that it can effectively work as a nano-scale hammer. The laser can focus higher levels of energy on specific areas of the textile, yarn or strand to create physical peaks and troughs in the surface of the textile, yarn or strand. The changes in morphology can allow for easier penetration of the dyestuffs into the textile, yarn or strand. The better the penetration of the dyestuff, the better the colour fastness of the resulting dyed textile, yarn or strand. Additionally, details or effects in the dyeing may be engineered through the addition of the laser to the AP plasma field. This process eliminates the need to create masks over the textile, yarn or strand to achieve the same effect.

Additionally or alternatively, the overlapping of the plasma field and the laser beam may be adapted to change a chemical property of the textile, yarn or strand. The more energetic AP plasma created in combination with the laser may initiate radicals in the surface of the textile, yarn or strand and attach ionized groups to the initiated radicals. Initiated radicals may increase polar characteristics in the fabric surface, which may result in greater hydrophilicity and other beneficial characteristics of the material that aid the dyeing step. By changing the surface of the textile, yarn or strand to increase the affinity between the textile and the dyestuff, changes to the chemistry of the dyestuffs are not required. Therefore, conventional methods such as dispersing the dyestuff in aqueous solution may be avoided. Therefore, use of water in the process may be avoided. Additionally, increasing the affinity between the textile, yarn or strand and the dyestuff can greatly increase the speed of dye uptake into the textile, yarn or strand. Increasing the speed of production allows a single factory to increase its throughput.

In some embodiments of the present invention, the step of dyeing the textile, yarn or strand by digital dyeing may comprise dispensing a dye from at least one nozzle. In digital dyeing, the dye is dispensed from a nozzle as a particle droplet. The droplet lands on the textile, yarn or strand in the desired position adjacent to the nozzle. The droplet penetrates into the textile, yarn or strand and fixes to the fibres in the textile, yarn or strand where it lands to dye that small area.

Additionally or alternatively, the step of dyeing the textile, yarn or strand by digital dyeing can comprise dispensing a dye from an array of nozzles. As discussed above, digital dyeing and printing technologies struggle to achieve uniform coverage over large areas. Single nozzles achieve only small areas of dye coverage. A single nozzle may be moved over the surface of a textile, yarn or strand to create wider coverage, but this requires complex mechanics and long processing times.

An array of nozzles creates a larger area of coverage. All nozzles working in unison can greatly reduce the processing time for dyeing large areas of textile, yarn or strand. The array of nozzles may be a single line of nozzles extending over the whole width of the textile, yarn or strand. The array of nozzles may extend over the same area as the high energy region of the plasma field so that the same area of textile, yarn or strand may be both pre-treated and dyed. The array of nozzles may be multiple lines of nozzles. In this way each portion of textile, yarn or strand passes under multiple nozzles to ensure thorough coverage of colour.

In some embodiments of the present invention, the method can further comprise at least one of the step of collecting an excess of the dispensed dye or the step of providing the excess of the dispensed dye back to the at least one nozzle or the array of nozzles. In some embodiments of the present invention, dye or dyestuff is dispensed at a controlled rate according to the needs of the textile, yarn or strand and the dyestuffs being used. However, in order to ensure effective full coverage of colour, excess dyestuff may be dispensed. In this case, some excess dyestuff will not be absorbed into the fibres of the textile, yarn or strand. This waste dyestuff will run off the textile, yarn or strand. The waste or excess of the dispensed dyestuff may be collected in the chamber as it runs off the textile, yarn or strand. Either gravity may be used in a simple manner so that the dyestuff pools at the bottom of the chamber, or a suction device may be implemented to collect the waste dyestuff. This waste dyestuff may then be transported from where it is collected and recirculated back into the dyeing process. In this way no dyestuff is wasted.

According to some aspects, the present invention relates to a system adapted for dyeing a textile, yarn or strand, in particular for use in footwear or apparel. The system may comprise a) at least one chamber; b) a mechanism for exposing at least a part of the textile, yarn or strand to a plasma field and a laser beam inside the at least one chamber; c) a mechanism for dyeing the textile, yarn or strand by digital dyeing inside the at least one chamber, d) wherein the plasma and the laser beam are at least partly overlapping to pre-treat the textile, yarn or strand prior to dyeing.

The mechanism for exposing at least a part of the textile, yarn or strand to a plasma field and a laser beam may for example be two electrodes and a laser, wherein the electrodes are adapted to generate the plasma field and the laser is adapted to generate a laser beam incident on the textile, yarn or strand. The mechanism for dyeing the textile, yarn or strand by digital dyeing may for example be a nozzle or an array of nozzles, wherein the nozzles are adapted to dispense dye on the textile, yarn or strand.

The various benefits of some embodiments of the present invention, as discussed above with regard to embodiments of a method of dyeing a textile, yarn or strand, also apply analogously to embodiments of a system adapted for dyeing a textile, yarn or strand and are not repeated here for reasons of brevity. Moreover, the system according to some embodiments of the present invention may comprise a mechanism to perform any of the above described embodiments of a method of dyeing a textile, yarn or strand. Similarly, for reasons of brevity, not all mechanisms applicable to perform the above described embodiments are mentioned in the following, but will be apparent to a person skilled in the art.

A single system such as some embodiments of the present invention that may be tuned for different uses eliminates the need for multiple machines in a production line for use with different textiles, yarns or strands or different dyes. Using a single system saves the cost of implementing multiple systems. Additionally, a single system that may be quickly adjusted to create a different field requires very little transfer time when moving between working on different textiles, yarns or strands. When moving between totally separate machines, there may be delays in warming up a new machine or moving the previous machine out of the way. Therefore, production time when moving between different textiles, yarns or strands is increased.

In some embodiments, the at least one chamber may be adapted for use at atmospheric pressure, room temperature or a combination thereof.

In some embodiments, the at least one chamber may further comprise a mechanism for applying a magnetic field, microwave radiation, ultrasound or a combination thereof to the plasma field.

In some embodiments, the mechanism for exposing at least a part of the textile, yarn or strand to a plasma field and a laser beam inside the at least one chamber may be adapted to arrange the plasma field between a first and a second roller electrode.

Additionally or alternatively, the mechanism for exposing at least a part of the textile, yarn or strand to a plasma field and a laser beam inside the at least one chamber may be adapted to arrange an overlapping area of the plasma field and the laser beam between the first and the second roller electrode.

In some embodiments, the overlapping of the plasma field and the laser beam may be adapted to change one of: a morphology of the textile, yarn or strand, a chemical property of the textile, yarn or strand or a combination thereof.

In some embodiments, the mechanism for dyeing the textile, yarn or strand by digital dyeing comprises a mechanism for dispensing a dye from at least one nozzle or an array of nozzles. In certain embodiments, the system further comprises at least one of: a mechanism for collecting an excess of the dispensed dye or a mechanism for providing the excess of the dispensed dye back to the at least one nozzle or the array of nozzles.

According to some aspects, the present invention relates to a textile, yarn or strand, in particular for use in footwear or apparel, wherein the textile, yarn or strand is dyed according to certain embodiments of a method of dyeing a textile, yarn or strand described above.

Overall, some embodiments of the present invention provide for a method, a system and a textile, yarn or strand to achieve an increased rate of production, a small production footprint, the elimination of the need for waste water treatment and results in a massive reduction in the capital employed in the coloration of textiles, yarns or strands.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, exemplary embodiments of the present invention are described in more detail, with reference to the accompanying figures. While specific feature combinations are described in the following with respect to the exemplary embodiments of the present invention, it is to be understood that the disclosure is not limited to such embodiments. In particular, not all features have to be present for realizing the invention, and the embodiments may be modified by combining certain features of some embodiments with at least one feature of other embodiments. Moreover, while the exemplary embodiments relate to dying a textile, the present invention also encompasses dying of single yarns or strands that are not arranged in a textile. What will be described in the following with reference to a textile is applicable to yarns or strands well.

In certain embodiments of the present invention, a pretreatment and dyeing system comprises a chamber 100. The chamber 100 is an area enclosed by two side walls 102, a top wall 104, a base 106, an entry side 108 and an exit side 110. The entry side 108 is opposite the exit side 110. In the entry side 108 is a first opening 112 configured to allow for insertion of a sheet of textile 114. In the exit side 110 is a second opening 116 configured to allow for the treated textile to be removed from the chamber 100. Each opening 112, 116 is a slit.

A sheet of textile 114 is provided from a roll 118 located adjacent the entry side 108 of the chamber 100. It is to be understood that when dying a yarn or strand according to the invention, the yarn or strand may be provided from a roll as well. The chamber 100 may be filled with at least one gas at atmospheric pressure, chosen to enhance the effects of the plasma. A gas delivery system 120 is employed to deliver these gases into the chamber. In some embodiments, safe and inert gases are used, such as Nitrogen, Oxygen, Argon and Carbon Dioxide. Additionally, process accelerants that are in the form of liquids can also be added to the atmosphere inside the chamber. These accelerants may be delivered via a spray or misting delivery system in order to create a thin layer of substance into the chamber. By varying the gases and accelerants, the most suitable combination of substances may be provided for each material to be treated. This way the system is suitable for use with a wide range of materials for a wide range of applications. A gas removal system may also be required, but is not shown. This gas removal system may utilize scrubbers to remove potentially toxic products from entering into the surrounding environment.

In some embodiments, two electrodes are positioned within the chamber 100. A first electrode 202 is positioned adjacent a second electrode 204. The first electrode 202 and second electrode 204 are elongate cylinders. Each electrode 202, 204 is configured to rotate about an axis 206, 208 that runs through the centre of each of the bases of the cylinder electrode 202, 204. The two electrodes 202, 204 are positioned parallel to each other. The two electrodes 202, 204 are positioned horizontal to the first opening 112 in the entry side 108 such that the sheet of textile 114 can pass from the first opening 112 between the two electrodes 202, 204. The two electrodes are driven to rotate by motors. The first electrode 202 is driven to rotate in direction A. The second electrode 204 is driven to rotate in direction B. By driving the electrodes 202, 204 in directions A and B respectively, the electrodes 202, 204 can transport the textile 114 through the chamber 100.

The electrodes 202, 204 comprise components for generating a high voltage alternating current atmospheric plasma field 302. Each electrode 202, 204 comprises an elongate electrode. The electrode of the first electrode 202 may be considered to be a cathode while the electrode of the second electrode 204 may be considered to be an anode. With the configuration described above, this allows the electrodes 202, 204 to create an AP plasma field 302. The electrodes 202, 204 extend across the full width of the first opening 112 in order to create a field that covers the width of the sheet of textile 114. This ensures that every part of the sheet of textile 114 is subject to a homogeneous AP plasma field 302. The highest energy area of the field 302 is the high energy region 303 positioned between the two electrodes 202, 204.

A high-power Ultra-Violet UV laser 304 is positioned within the chamber 100. The laser beam 306 is directed towards the high energy region 303. The laser beam 306 is positioned to be incident on the sheet of material 114 at an angle $\alpha°$.

Figure 4A:
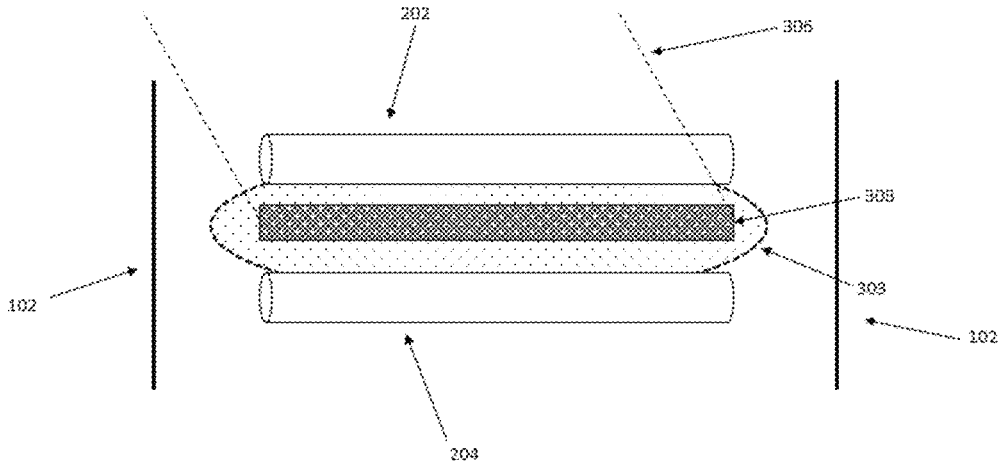
FIGS. 4*a* and 4*b* are diagrams illustrating a front view cut-through of a part of the chamber including pre-treatment mechanisms according to certain embodiments of the present invention.

In some embodiments, such as shown in FIG. 4*a*, the laser beam 306 has a rectangular cross section. The cross section has a width equal to the length of the electrodes 202, 204. The interaction area 308 covered by the laser beam 306 within the high energy region 303 extends across the width of the sheet of textile 114.

Figure 4B:
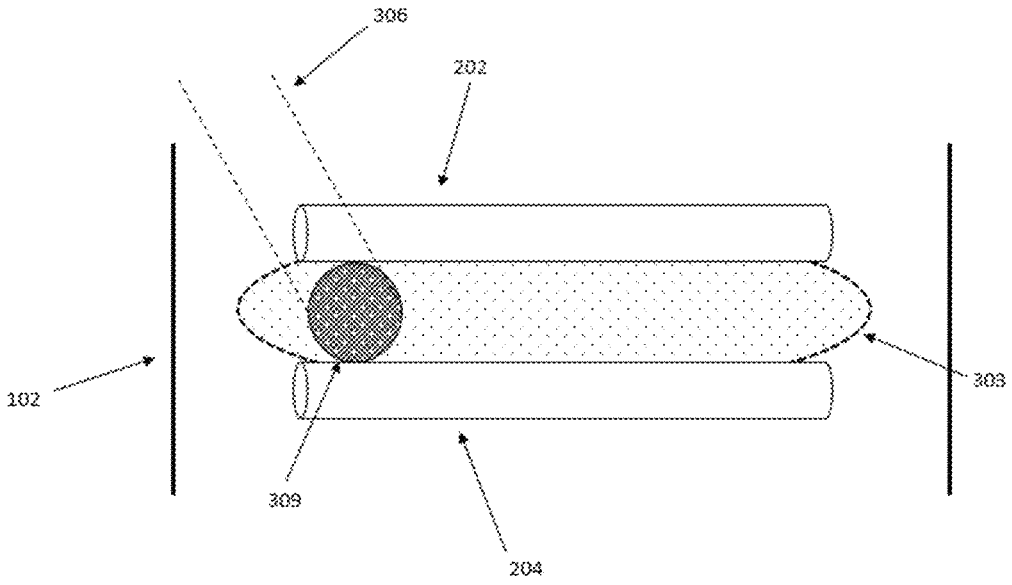

In some embodiments, such as shown in FIG. 4*b*, laser beam 306 has a circular cross section. The cross section has a diameter equal to the separation distance of the electrodes 202, 204. The interaction area 309 covered by the laser beam 306 within the high energy region 303 extends across only a portion of the sheet of textile 114.

Figure 5:
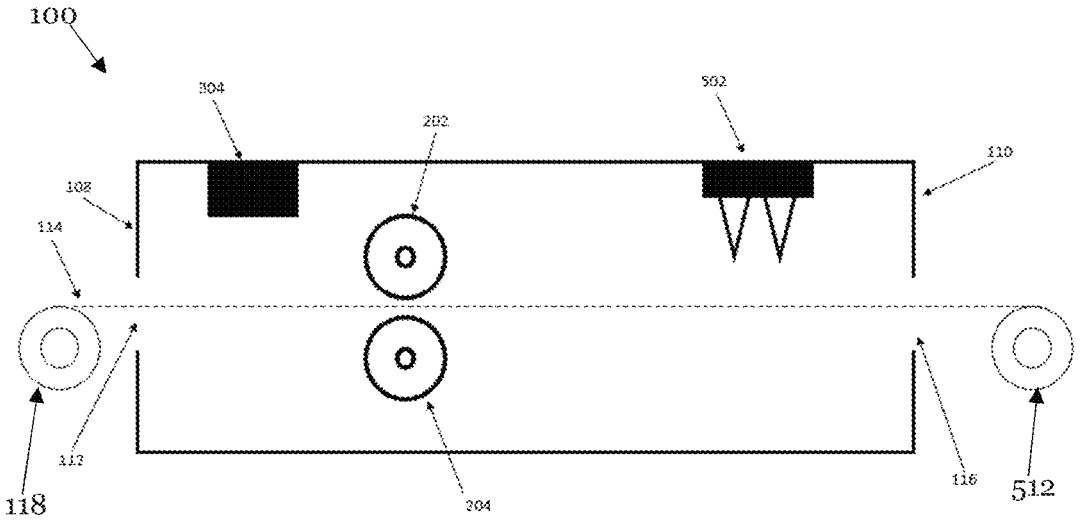
FIG. 5 is a diagram illustrating a side view cut-through of a chamber including both pre-treatment and dyeing mechanisms according to certain embodiments of the present invention.
Figure 6:
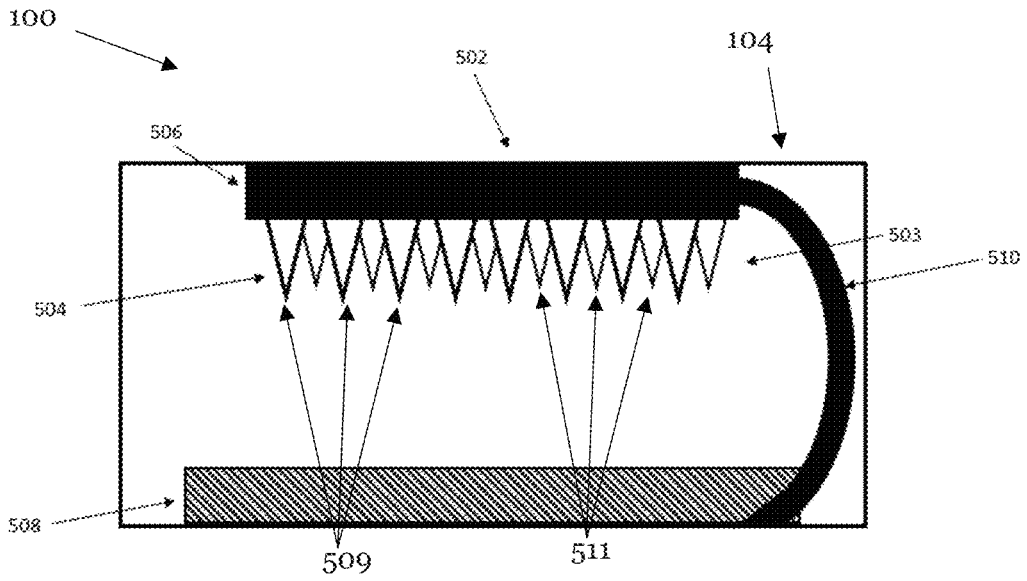
FIG. 6 is a diagram illustrating a front view cut-through of a part of the chamber including dyeing mechanisms according to certain embodiments of the present invention.

A dyeing assembly 502 according to certain embodiments is also shown in FIG. 5 and FIG. 6. The dyeing assembly 502 is formed of an array 503 of nozzles 504 each configured to dispense dyestuff from a reservoir 506. The nozzles 504 are positioned across the chamber 100, extending down from the top wall 104. The array 503 extends across a width of the chamber corresponding to the width of the sheet of textile 114. The array 503 comprises a first row 509 of nozzles 504 and a second row 511 of nozzles 504. In alternative embodiments, further rows of nozzles 504 may be added to the dyeing assembly 502.

Below the sheet of textile 114, excess dyestuff from the nozzles 504 may pool in a collection tray 508 having passed through the sheet of textile 114. From the collection tray 508 a pump system 510 transports the excess dyestuff back to the reservoir 506 where the dyestuff may be reused.

The sheet of textile 114, driven by the electrodes 202, 204 passes into the chamber 100 through the first opening 112, through the high energy region 303 for pre-treatment, under the dyeing assembly 502 and out through the second opening 116. The sheet of textile 114 may then be immediately collected on a roll 512 for transportation, storage or further processing.

In the following, further examples are described to facilitate the understanding of the invention:

Example 1. A method of dyeing a textile (114), yarn or strand, in particular for use in footwear or apparel, the method comprising the steps of: a. exposing at least a part of the textile, yarn or strand to a plasma field (302) and a laser beam (306); and b. dyeing the textile, yarn or strand by digital dyeing, c. wherein the plasma field and the laser beam are at least partly overlapping to pre-treat the textile, yarn or strand prior to dyeing, and d. wherein the method is performed inside one or more chamber(s) (100).

Example 2. The method of Example 1, wherein the method is performed at atmospheric pressure, room temperature or a combination thereof.

Example 3. The method of Examples 1 or 2, wherein the method further comprises applying a magnetic field, microwave radiation, ultrasound or a combination thereof to the plasma field.

Example 4. The method of one of Examples 1 to 3, wherein the plasma field is arranged between a first (202) and a second (204) roller electrode.

Example 5. The method of one of Examples 1 to 4, wherein an overlapping area of the plasma field and the laser beam is arranged between a first (202) and a second (204) roller electrode.

Example 6. The method of one of Examples 1 to 5, wherein the overlapping of the plasma field and the laser beam is adapted to change one of: a morphology of the textile, yarn or strand, a chemical property of the textile, yarn or strand or a combination thereof.

Example 7. The method of one of Examples 1 to 6, wherein dyeing the textile, yarn or strand by digital dyeing comprises dispensing a dye from at least one nozzle (504) or an array (503) of nozzles (504).

Example 8. The method of the preceding Example, wherein the method further comprises the step of: collecting an excess of the dispensed dye, and/or providing the excess of the dispensed dye back to the at least one nozzle or the array of nozzles.

Example 9. A system adapted for dyeing a textile (114), yarn or strand, in particular for use in footwear or apparel, the system comprising: a. one or more chamber(s) (100); b. means for exposing at least a part of the textile, yarn or strand to a plasma field (302) and a laser beam (306) inside the one or more chamber(s); c. means for dyeing (502) the textile, yarn or strand by digital dyeing inside the one or more chamber(s), d. wherein the plasma and the laser beam are at least partly overlapping to pre-treat the textile, yarn or strand prior to dyeing.

Example 10. The system of Example 9, wherein the one or more chamber(s) is (are) adapted for use at atmospheric pressure, room temperature or a combination thereof.

Example 11. The system of Example 9 or 10, wherein the one or more chamber(s) further comprise(s) means for applying a magnetic field, microwave radiation, ultrasound or a combination thereof to the plasma field.

Example 12. The system of one of Examples 9 to 11, wherein the means for exposing at least a part of the textile, yarn or strand to a plasma field and a laser beam inside the one or more chamber(s) are adapted to arrange the plasma field between a first (202) and a second (204) roller electrode and/or to arrange an overlapping area of the plasma field and the laser beam between a first (202) and a second (204) roller electrode.

Example 13. The system of one of Examples 9 to 12, wherein the overlapping of the plasma field and the laser beam is adapted to change one of: a morphology of the textile, yarn or strand, a chemical property of the textile, yarn or strand or a combination thereof.

Example 14. The system of one of Examples 9 to 13, wherein the means for dyeing the textile, yarn or strand by digital dyeing comprise means for dispensing a dye from at least one nozzle (504) or an array (503) of nozzles (504), wherein the system preferably further comprises: means for collecting (508) an excess of the dispensed dye, and/or means for providing (510) the excess of the dispensed dye back to the at least one nozzle or the array of nozzles.

Example 15. A textile, yarn or strand (114), in particular for use in footwear or apparel, wherein the textile, yarn or strand is dyed according to the method of one of Examples 1 to 8.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A method of dyeing a textile, yarn or strand, for use in footwear or apparel, the method comprising the steps of:

exposing at least a part of the textile, yarn or strand to a plasma field and a laser beam; and dyeing the textile, yarn or strand by digital dyeing, wherein the plasma field and the laser beam are at least partly overlapping to pre-treat the textile, yarn or strand prior to dyeing, and wherein the method is performed inside at least one chamber and at room temperature.

2. The method of claim 1, wherein the method is performed at atmospheric pressure.

3. The method of claim 1, further comprising applying a magnetic field, ultrasound, or a combination thereof to the plasma field.

4. The method of claim 1, wherein the plasma field is arranged between a first and a second roller electrode.

5. The method of claim 1, wherein an overlapping area of the plasma field and the laser beam is arranged between a first and a second roller electrode.

6. The method of claim 5, wherein the overlapping area of the plasma field and the laser beam is adapted to change one of: a morphology of the textile, yarn or strand, a chemical property of the textile, yarn or strand, or a combination thereof.

7. The method of claim 1, wherein dyeing the textile, yarn or strand by digital dyeing comprises dispensing a dye from at least one nozzle or an array of nozzles.

8. The method of claim 7, further comprising at least one of:

collecting an excess of the dispensed dye or providing the excess of the dispensed dye back to the at least one nozzle or the array of nozzles.

9. The method of claim 1, wherein the method is performed inside a single chamber.

10. The method of claim 1, wherein exposing at least a part of the textile, yarn or strand to a plasma field and a laser beam comprises exciting only certain portions of the textile, yarn or strand to control the excitation of the textile, yarn or strand.

11. The method of claim 1, wherein exposing at least a part of the textile, yarn or strand to a plasma field and a laser beam comprises exposing only certain portions of the textile, yarn, or strand to both the plasma field and the laser beam.

* * * * *